US009803494B2

(12) United States Patent
Stricker et al.

(10) Patent No.: US 9,803,494 B2
(45) Date of Patent: Oct. 31, 2017

(54) SEALING ELEMENT, SEALING UNIT, AND TURBOMACHINE

(71) Applicant: MTU Aero Engines AG, Munich (DE)

(72) Inventors: Hans Stricker, Munich (DE); Stefan Rauscher, Aichach (DE)

(73) Assignee: MTU Aero Engines AG, Munich (DE)

( * ) Notice: Subject to any disclaimer, the term of this patent is extended or adjusted under 35 U.S.C. 154(b) by 344 days.

(21) Appl. No.: 14/558,415

(22) Filed: Dec. 2, 2014

(65) Prior Publication Data

US 2015/0152742 A1 Jun. 4, 2015

(30) Foreign Application Priority Data

Dec. 4, 2013 (EP) ..... 13195751

(51) Int. Cl.
*F01D 11/12* (2006.01)

(52) U.S. Cl.
CPC ..... *F01D 11/12* (2013.01); *F05D 2230/60* (2013.01)

(58) Field of Classification Search
CPC ..... F01D 11/00; F01D 11/08; F01D 11/12; F01D 11/122; F01D 11/125; F01D 11/127; F05D 2230/60; F16J 15/16
USPC ..... 415/173.1, 173.3, 173.4, 173.5, 174.2, 415/174.4, 174.5; 277/411–412, 277/414–416, 421
See application file for complete search history.

(56) References Cited

U.S. PATENT DOCUMENTS

| | | | | |
|---|---|---|---|---|
| 3,730,640 | A * | 5/1973 | Rice | F01D 11/08 415/117 |
| 4,053,254 | A | 10/1977 | Chaplin et al. | |
| 4,303,371 | A | 12/1981 | Eckert | |
| 4,536,127 | A * | 8/1985 | Rossmann | F01D 11/122 277/415 |
| 5,044,881 | A * | 9/1991 | Dodd | F01D 11/24 415/173.3 |
| 5,899,660 | A * | 5/1999 | Dodd | F01D 9/041 415/108 |
| 6,120,242 | A * | 9/2000 | Bonnoitt | F01D 11/127 415/174.4 |
| 2004/0145251 | A1* | 7/2004 | Clouse | F01D 5/26 310/51 |
| 2004/0213666 | A1* | 10/2004 | Gieg | F01D 25/246 415/170.1 |
| 2015/0016969 | A1* | 1/2015 | Gieg | F01D 25/183 415/173.1 |

FOREIGN PATENT DOCUMENTS

| | | |
|---|---|---|
| EP | 1231420 | 8/2002 |
| EP | 2357322 | 8/2011 |

* cited by examiner

*Primary Examiner* — Christopher Verdier
(74) *Attorney, Agent, or Firm* — Davidson, Davidson & Kappel, LLC

(57) ABSTRACT

A sealing element is described for positioning in a turbomachine, for the self-securing of a sealing element in a mounting position, its support structure having a safeguard which has a springy catch section, whose mounting surface is inclined at a smaller angle in the mounting direction than a securing surface in the opposite direction, a sealing unit, and a turbomachine.

20 Claims, 2 Drawing Sheets

SEALING ELEMENT, SEALING UNIT, AND TURBOMACHINE

This claims the benefit of German Patent Application DE 13195751.6, filed Dec. 4, 2013 and hereby incorporated by reference herein.

The present invention relates to a sealing element of a turbomachine, a sealing unit having at least one sealing element, and a turbomachine having such a sealing unit.

BACKGROUND

In turbomachines such as gas turbines and aircraft engines, radial gaps on the turbine side between rotor-side moving blade rows and the housing areas enclosing moving blade rows are generally sealed off or reduced in size with the aid of a sealing unit. The sealing unit is composed of a plurality of sealing elements or ring segments, which each have at least one intake lining or rub coating, which is fastened on a support structure operatively linked to the housing area. Known support structures have at least one dimensionally stable retaining element, which is situated in the mounted state of the turbomachine between two sections of the housing area having an axial screw connection to one another. To secure the sealing unit or its sealing element during the mounting or during the transport of the not-yet-completed turbomachine, i.e., when the housing sections are not screwed together, the support structures may each have a safeguard, which may also be referred to as a mounting safeguard or as a location safeguard.

In a known support structure, a safeguard and at least one retaining element are situated one behind the other viewed in the mounting direction, the safeguard having a catch section having a mounting surface inclined by a mounting angle in the mounting direction and a securing surface inclined by a safety angle in the opposite direction. For the elastic implementation of the catch section, it is attached via a spring section on the rear side. The safety angle is selected in such a way that a high retaining force is achieved. The mounting angle is set in accordance with the safety angle in such a way that to mount the support structure, a correspondingly large mounting force must be applied, which may result in plastic deformation of the safeguard.

SUMMARY OF THE INVENTION

It is an object of the present invention to provide a sealing element of a turbomachine, which remedies the above-mentioned disadvantages and in particular enables easy mounting and reliable securing in location during the mounting. Furthermore, it is an object of the invention to provide a sealing unit, which is simple to mount and remove in a turbomachine, and to provide a turbomachine, the at least one sealing unit of which is securely retained on a housing section during the mounting or the transport.

The present invention provides a sealing element of a turbomachine for setting a radial gap between a moving blade row and a housing area has a support structure having a radially inner side, on which an intake lining is fastened, and a radially outer side, on which at least one dimensionally stable retaining element for retaining the support structure in a setpoint position on the housing area is situated. In addition, the support structure has a safeguard for securing the support structure in its setpoint position during the mounting or the transport. The at least one retaining element and the safeguard are situated one behind the other in the mounting direction, the safeguard having a catch section having a mounting surface inclined by a mounting angle in the mounting direction and a securing surface inclined by a safety angle in the opposite direction. The catch section is furthermore elastically mounted on the outer side via a spring section. According to the present invention, the mounting angle is smaller than the safety angle.

Because the mounting angle is smaller than the safety angle, on the one hand, simple mounting may be achieved and, on the other hand, a high level of securing action and therefore reliable securing in location during the mounting may be achieved. The mounting angle and the safety angle are optimally adaptable independently of one another and in this way to their particular function—low mounting force or high retaining force. Damage to the support structure as a result of an excessively large mounting angle is precluded.

The mounting of the sealing element on the housing area may be made particularly easy if the at least one retaining element has a retaining section extending in the mounting direction to form a sliding engagement with a corresponding receptacle of the turbomachine. In this way, the support structure may be transferred into its setpoint position by a linear movement. The spring section enables an automatic deflection of the catch section in a second direction and therefore automatic latching.

To mount the sealing element at multiple points, a further retaining element may be provided, the catch section preferably being situated between the retaining elements, the further retaining element being able to form a sliding engagement in the mounting direction with a corresponding receptacle of the turbomachine. Due to the sliding engagement of the second holding element in the mounting direction, both retaining elements are simultaneously brought into an active engagement with the respective housing receptacle by a linear movement.

The spring section is preferably a profile having two legs situated one over the other, the outer or radial outer leg of which, in relation to a machine longitudinal axis of the turbomachine, merges into the catch section and the inner or radial inner leg of which merges into a fastening section attached on the outer side. Such a spring section enables a large deflection or elasticity of the catch section and is simple to manufacture. Exemplary profiles with two legs are U-profiles, V-profiles, and W-profiles.

To enlarge the spring action, the inner leg may be inclined by a blade angle in the mounting direction. The inclination causes a change of the mounting angle during the mounting and of the safety angle in the event of a load in the removal direction. The mounting force may be reduced further by this inclination.

The outer leg preferably extends in the mounting direction and is therefore not inclined in the mounting direction. In this way, the two legs are inclined similarly to an asymmetrical U-profile in relation to one another, which has a positive effect on the reduction of the mounting force or the increase of the retaining force.

The mounting angle is preferably at least 10° smaller, more preferably 20° to 30° smaller than a minimum safety angle. The minimum safety angle is the smallest possible safety angle and is substantially a function of the coefficient of friction between the housing section and the securing surface. Mounting with particularly low mounting force takes place due to such a reduced mounting angle.

A removal of the sealing element may be simplified if the spring section is situated in front of the catch section in the mounting direction and the catch section merges into a rear free end section in the mounting direction. The free end section is situated in front in the removal direction and is therefore freely accessible during a removal. In this way, for example, a compression force oriented radially from the outside to the inside may be introduced into the spring section using a tool and a radial overlap of the securing surface on the securing element side with the retaining surface on the housing side may be reduced.

A sealing unit according to the present invention of a turbomachine has a plurality of sealing elements according to the present invention. Such a sealing unit may be mounted without damage and is secured reliably in its setpoint position during the mounting.

A turbomachine according to the present invention has at least one sealing unit according to the present invention. The turbomachine is distinguished by an optimum radial gap in the area of the sealing unit, since it is mounted without damage and in addition in its setpoint position.

BRIEF DESCRIPTION OF THE DRAWINGS

Preferred exemplary embodiments of the present invention will be explained in greater detail hereafter on the basis of greatly simplified schematic views.

DETAILED DESCRIPTION

Figure 1:
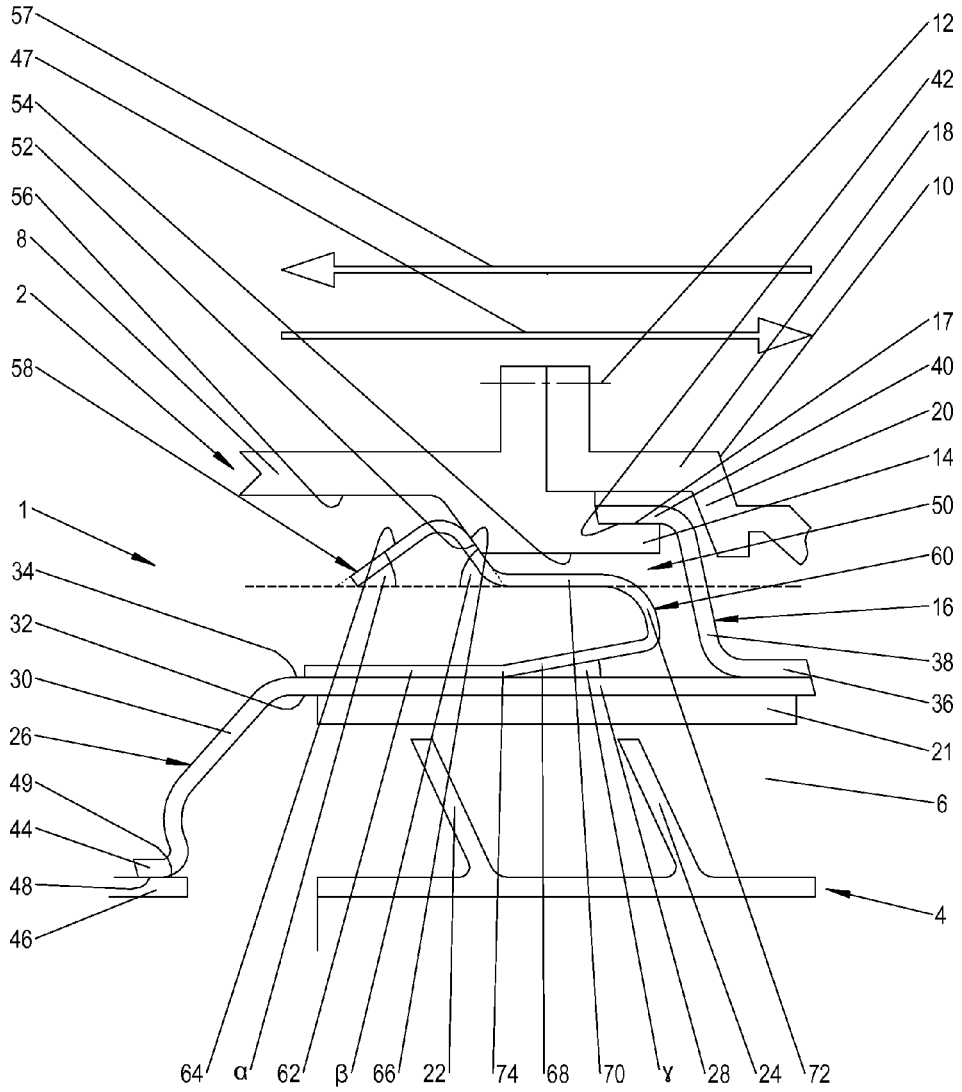
FIG. 1 shows an axial section through a first exemplary embodiment of a sealing element according to the present invention, which is situated on a housing area of a turbomachine.

FIG. 1 shows a first exemplary embodiment of a sealing element 1 according to the present invention in section along a machine longitudinal axis of a turbomachine. The machine longitudinal axis extends in an axial direction. Directional specifications such as axial or radial relate to the machine longitudinal axis. Directional specifications such as upstream and downstream or location specifications such as front and rear relate to the flow direction of a hot gas flowing through the turbomachine. When directional specifications and/or location specifications relate to a mounting direction or removal direction, this will be expressly mentioned.

The turbomachine is, for example, a gas turbine and in particular an aircraft engine. Sealing element 1 is a ring segment of a sealing unit, which is situated here in a turbine-side housing area 2 of the turbomachine. In principle, sealing element 1 may also be situated on the compressor side. Sealing element 1 or the sealing unit including at least one sealing element is used for setting and in particular reducing a radial gap between housing area 2 and a moving blade row 4 enclosed by housing area 2. Moving blade row 4 is situated rotating in a ring space 6 around the machine longitudinal axis. Hot gas flows through ring space 6 essentially in the direction of the machine longitudinal axis and axially from left to right here.

Housing area 2 is composed here of two housing sections 8, 10 having ring flanges, which are screwed together with one another in the area of their ring flanges as indicated by dot-dash line 12. Housing sections 8, 10 themselves may be divided into a lower half and an upper half, which are or will be joined in a horizontal plane.

Front housing section 8 has a receptacle 14 to cooperate with a rear dimensionally stable retaining element 16 of sealing element 1. Receptacle 14 is designed for this purpose as an axial projection, which extends in the flow direction, having a radial fitting surface 17.

Rear housing section 10 has an axial peripheral wall 18 extending downstream from the ring flange and a ring wall 20 extending radially inward, downstream from the ring flange, from the peripheral wall 18. Peripheral wall 18 has a length or axial extension such that in the mounted state of sealing element 1 or the sealing unit, an axial gap is formed between rear retaining element 16 and ring wall 20. Ring wall 20 has a radial extension or height here such that it extends slightly radially inward beyond receptacle 14.

Sealing element 1 has an intake lining or rub coating 21, which is situated opposite to peripheral sealing webs 22, 24, which are situated one behind another in the flow direction, of moving blade row 4. To mount intake lining 21, sealing element 1 has a support structure 26. Support structure 26 and intake lining 21 are metallic. In the exemplary embodiment shown here, intake lining 21 and support structure 26 are manufactured separately from one another and subsequently joined. Intake lining 21 may also be manufactured integrally with support structure 26, however. This may be carried out, for example, with the aid of a generative manufacturing method such as laser sintering or a laser fusion method and enables the manufacturing of sealing element 1 as a closed ring and therefore as a one-piece sealing unit.

Support structure 26 has an axial base section 28 and a wall section 30, which is inclined in the radial direction and is situated upstream from base section 28. Base section 28 has a radially inner side 32, on the hot gas or ring chamber side, on which intake lining 21 is situated, and an opposing radially outer side 34, which faces toward the cool air side or housing area 2. Outer side 34 is provided with rear retaining element 16, which cooperates with housing-side receptacle 14.

Rear retaining element 16 is designed to be S-shaped here, having an axial foot section 36 attached to outer side 34, a web 38 extending radially outward from foot section 36, and an axial head or retaining section 40 extending upstream from web 38. Retaining section 40 has in particular a contact surface 42, which extends upstream and points in the direction of ring space 6, for cooperating with fitting surface 17 of receptacle 14.

In addition, support structure 26 in this exemplary embodiment has a front dimensionally stable retaining element 44, which extends axially upstream of wall section 30 and cooperates with a corresponding stator-side receptacle 46. Front retaining element 44 has a front radial contact surface 48 extending in the axial direction, which cooperates with a fitting surface 49 of receptacle 46 extending in the axial direction. Stator-side receptacle 46 is, for example, a rear platform area of an upstream moving blade row.

To secure sealing element 1 in a setpoint position during the mounting or during the transport, in the case of which housing sections 8, 10 are separated from one another, support structure 26 has a safeguard 50. This means that sealing element 1 or the sealing unit having its retaining elements 16, 44 is located in a sliding engagement with receptacles 14, 46, but the sliding engagements may be disengaged by a sufficiently forceful removal movement in opposite direction 47. However, self-loosening of sealing element 1 from front housing section 8 is prevented because of safeguard 50. Specifically, this means in this exemplary embodiment that sealing element 1 or the sealing unit is also secured on front housing section 8 in the setpoint position thereof when rear housing section 10 is not yet screwed together with front housing section 8.

Safeguard 50 extends from outer side 34 between retaining elements 16, 44 and cooperates with a housing-side retaining surface 52. Retaining surface 52 is an inclined surface, which is situated opposite to the receptacle of rear retaining element 16 on front housing section 8 and extends between a radial inner peripheral surface 54 and an upstream radial outer peripheral surface 56 of front housing section 8. It therefore extends diagonally in mounting direction 57.

Safeguard 50 has a catch section 58, which is attached via a spring section 60 and a fastening section 62 on outer side 34.

Catch section 58 has a mounting surface 64, which is inclined by a mounting angle $\alpha$ in the mounting direction, and a securing surface 66, which is inclined by a safety angle $\beta$ in the opposite direction. To mount sealing element 1 with a small mounting force and simultaneously for reliable securing, mounting angle $\alpha$ is smaller than safety angle $\beta$ or safety angle $\beta$ is greater than mounting angle $\alpha$. Securing surface 66 is located in the mounted state in contact with housing-side retaining surface 52. For large-area contact, retaining surface 52 is therefore preferably inclined by an angle (not shown) in the mounting direction, which is equal to safety angle $\beta$ in the opposite direction, i.e., in mounting direction 57. Mounting direction 57 is an axial upstream movement. Opposite direction 47 or removal direction is therefore an axial downstream movement.

Spring section 60 is a U-shaped profile, which is somewhat asymmetrical in longitudinal section, having a radial inner leg 68, a radial outer leg 70, and a curve section 72 connecting legs 68, 70 to one another. Inner leg 68 merges at its front end into fastening section 62, which is attached over a large area on outer side 34. Inner leg 68 is inclined by a blade angle $\gamma$ in the mounting direction and merges at its rear end into curve section 72. Outer leg 70 extends in the mounting direction and connects curve section 72 to catch section 58, which is located upstream of curve section 72.

For the mounting of sealing element 1, housing sections 8, 10 are separated from one another. Sealing element 1 is brought into sliding engagement with front housing section 8 in the mounting direction, i.e., opposite to the flow direction, from back to front by an axial sliding movement. Front retaining element 44 is pushed with its contact surface 48 along rear platform area 46 of the upstream moving blade row and rear retaining element 16 is pushed with its contact surface 42 along axial projection 14. During the insertion, safeguard 50 runs with its mounting surface 64 on axial projection 14. Because of the spring action of spring section 60, safeguard 50 is elastically compressed from its original shape and/or slightly elastically twisted around transition area 74 between inner leg 68 and fastening section 62 and catch section 58 moves along inner peripheral surface 54 of front housing section 8, until it assumes its original shape again after passing inner peripheral surface 54 and is located with its mounting surface 64 in contact with retaining surface 52.

In the mounted state, retaining elements 16, 44 are located in sliding engagement with receptacles 14, 46 and safeguard 50 lies with its securing surface 66 flatly against retaining surface 52. Sealing element 1 is therefore secured in the setpoint position against falling out. Because of small mounting angle $\alpha$, only a small axial mounting force is necessary for the mounting. Because of large safety angle $\beta$, however, a large axial retaining force is achieved, so that reliable self-securing is achieved, on the one hand. The inclination of inner leg 68 reinforces the particular effect. That is, mounting angle $\alpha$ is reduced further by the inclination of inner leg 68 during the insertion. Front housing section 8 may now be transported, for example, without the risk that sealing element 1 will leave its setpoint position on front housing section 8. Rear housing section 10 therefore does not have to be screwed together with front housing section 8 immediately after the mounting of sealing element 1 or the sealing unit, to prevent a location change of sealing element 1.

Mounting angle $\alpha$ is preferably at least 10°, more preferably 20° to 30°, smaller than a minimum safety angle. The minimum safety angle is the smallest possible safety angle $\beta$ and is substantially a function of the coefficient of friction between retaining surface 52 and securing surface 66.

For the removal of sealing element 1 or the sealing unit, it is preferably to be separated in opposite direction 47 from front housing section 8, after overcoming the retaining force, safeguard 50 being elastically compressed or slightly twisted around transition area 74 and only assuming its original shape after passing axial projection 14.

Figure 2:
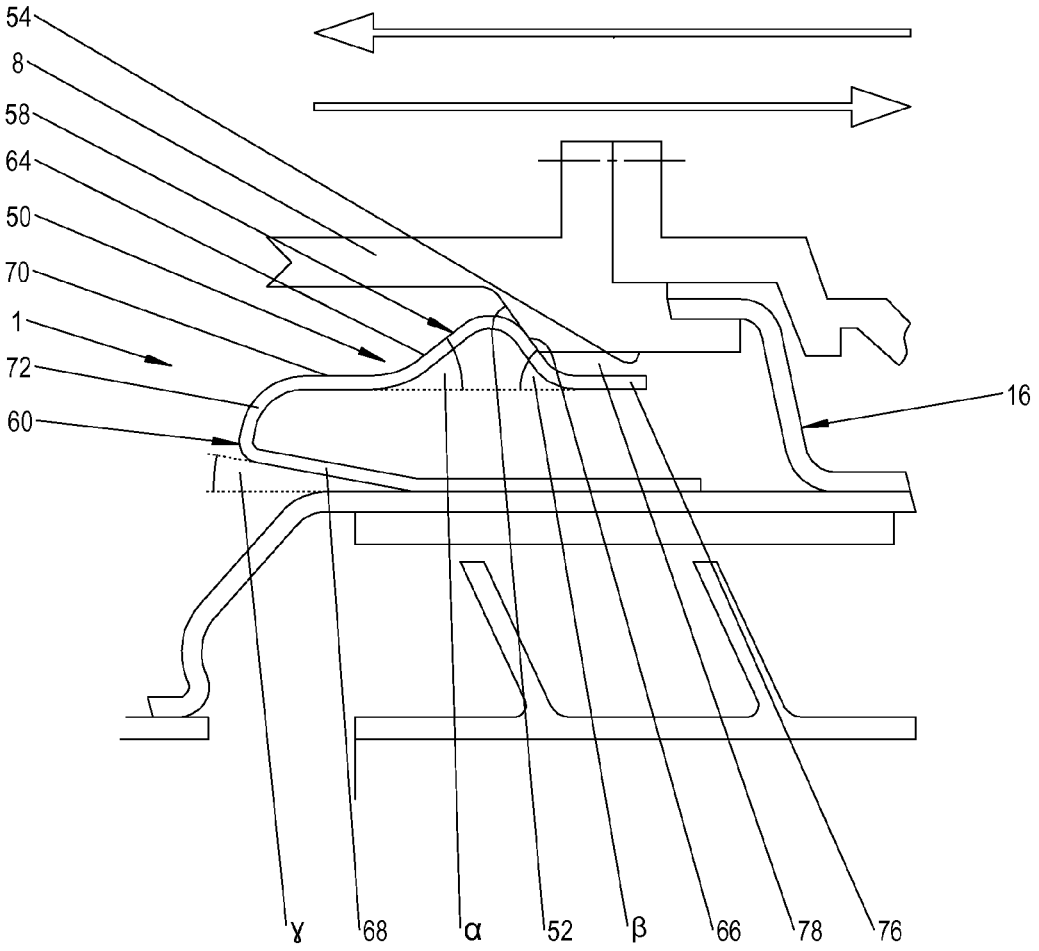
FIG. 2 shows an axial section through a second exemplary embodiment of a sealing element according to the present invention, which is situated on a housing area of a turbomachine.

FIG. 2 shows a second exemplary embodiment of a sealing element 1 according to the present invention in section along a machine longitudinal axis of a turbomachine.

In contrast to the first exemplary embodiment according to FIG. 1, spring section 60 of safeguard 50 is situated rotated by 180° around its vertical axis according to the view in FIG. 2 and is positioned upstream of catch section 58. Spring section 60 is situated quasi-inverted. In this way, curve section 72 is situated upstream of radial inner leg 68 and upstream of radial outer leg 70. The orientation of catch section 58 has not changed, so that because of the reorientation of spring section 60, radial outer leg 70 now merges into mounting surface 64 and not into securing surface 66 of catch section 58. In other words, spring section 60 is arranged in front of catch section 58 in the mounting direction or spring section 60 is arranged behind catch section 58 in the removal direction. As a result of the changed alignment of spring section 60, a position of blade angle $\gamma$ of inner leg 68 has also changed.

In a further difference from the first exemplary embodiment of FIG. 1, catch section 58 merges upstream into a rear free end section 76 extending in the axial direction, which in the mounted state of sealing element 1 is radially spaced apart from opposing radial inner peripheral surface 54 of front housing section 8. In the removal direction, free end section 76 is situated in front of catch section 58 and is therefore freely accessible. Due to the radial spacing, a receptacle space 78 for a removal tool is provided, for example, with the aid of which a compression force oriented radially from the outside to the inside is introduced into safeguard 50 upon the interaction with free end section 76. This is advantageous in particular, for example, if safeguard 50 is situated between two retaining elements 16 in the peripheral direction, since then the "unlocking" is simplified by the introduction of the radial compression force. Of course, mechanisms other than free end section 76 in combination with receptacle space 78 are conceivable for this purpose.

For the removal of sealing element 1, a tool, for example, a screwdriver, is inserted into receptacle space 78. The tool is moved into contact with free end section 76 and is moved radially from the outside to the inside, whereby the compression force is introduced into safeguard 50, which is such that spring section 60 is compressed and therefore the overlap of securing surface 66 with retaining surface 52 of front housing section 8 is reduced, so that sealing element 1 may be removed in the axial direction in a simplified way.

A sealing element is described for positioning in a turbomachine, for the self-securing of the sealing element in a mounting position, its support structure having a safeguard which has a springy catch section, whose mounting surface is inclined at a smaller angle in the mounting direction than a securing surface in the opposite direction, a sealing unit, and a turbomachine.

LIST OF REFERENCE NUMERALS

1 sealing element
2 housing area
4 moving blade row
6 ring space
8 front housing section
10 rear housing section
12 line
14 receptacle/axial projection
16 rear retaining element
17 fitting surface
18 peripheral wall
20 ring wall
21 intake lining/rub coating
22 sealing web
24 sealing web
26 support structure
28 base section
30 wall section
32 radially inner side
34 radially outer side
36 foot section
38 web
40 retaining section
42 contact surface
44 front retaining element
46 receptacle/rear platform area
47 opposite direction
48 contact surface
59 fitting surface
50 safeguard
52 retaining surface
54 inner peripheral surface
56 outer peripheral surface
57 mounting direction
58 catch section
60 spring section
62 fastening section
64 mounting surface
66 securing surface
68 inner leg
70 outer leg
72 curve section
74 transition area
76 end section
78 receptacle space
α mounting angle
β safety angle
γ blade angle

What is claimed is:

1. A sealing element of a turbomachine for setting a radial gap between a moving blade row and a housing area, the sealing element comprising:

a support structure having a radially outer side and a radially inner side;

an intake lining situated on the radially inner side;

at least one retaining element situated on the radially outer side for retaining the support structure in a setpoint position; and a safeguard situated on the radially outer side for securing the support structure in the setpoint position during mounting or transport, the at least one retaining element and the safeguard being situated one behind another in a mounting direction, the safeguard having a catch section having a mounting surface inclined by a mounting angle in the mounting direction, and having a securing surface inclined by a safety angle in an opposite direction opposite the mounting direction, the catch section elastically mounted via a spring section, the mounting angle being smaller than the safety angle;

wherein the spring section is a profile with an outer leg and an inner leg situated one above the other, the outer leg merging into the catch section and the inner leg merging into a fastening section attached on the radially outer side.

2. The sealing element as recited in claim 1 wherein the at least one retaining element has a retaining section extending in the mounting direction for forming a sliding engagement with a corresponding receptacle of the turbomachine.

3. The sealing element as recited in claim 1 wherein the at least one retaining element includes first and second retaining elements, and the catch section is situated between the first and second retaining elements and a sliding engagement may be formed in the mounting direction with a corresponding receptacle of the turbomachine with the aid of the second retaining element.

4. The sealing element as recited in claim 1 wherein the inner leg is inclined by a blade angle in the mounting direction.

5. The sealing element as recited in claim 1 wherein the outer leg extends in the mounting direction.

6. The sealing element as recited in claim 1 wherein the mounting angle is at least 10° smaller than a minimum safety angle.

7. The sealing element as recited in claim 6 wherein the mounting angle is 20° to 30° smaller than the minimum safety angle.

8. The sealing element as recited in claim 6 wherein the spring section is situated in front of the catch section in the mounting direction and the catch section merges in the mounting direction into a rear free end section.

9. The sealing element as recited in claim 1 wherein the spring section is situated in front of the catch section in the mounting direction and the catch section merges in the mounting direction into a rear free end section.

10. The sealing element as recited in claim 1 wherein the spring section is situated in front of the catch section in the mounting direction and the catch section merges in the mounting direction into a rear free end section.

11. A turbomachine comprising:

a moving blade row;

a housing area including a first housing section and a second housing section, the first and second housing sections screwed together in a mounted state of the turbomachine;

a sealing element for setting a radial gap between the moving blade row and the housing area, the sealing element including:

a support structure having a radially outer side and a radially inner side;

an intake lining situated on the radially inner side;

at least one retaining element situated on the radially outer side for retaining the support structure in a setpoint position, the retaining element being located between the first and second housing sections in the mounted state; and a safeguard situated on the radially outer side for securing the support structure in the setpoint position during mounting into the mounted state or during transport when the first and second housing sections are not screwed together;

the at least one retaining element and the safeguard being situated one behind another in a mounting direction, the safeguard having a catch section having a mounting surface inclined by a mounting angle in the mounting direction, and having a securing surface inclined by a safety angle in an opposite direction opposite the mounting direction, the catch section elastically mounted via a spring section, the mounting angle being smaller than the safety angle, wherein the spring section is a profile with an outer leg and an inner leg situated one above the other, the outer leg merging into the catch section and the inner leg merging into a fastening section attached on the radially outer side.

12. The turbomachine as recited in claim 11 wherein the at least one retaining element has a retaining section extending in the mounting direction for forming a sliding engagement with a corresponding receptacle of the turbomachine.

13. The turbomachine as recited in claim 11 wherein the at least one retaining element includes first and second retaining elements, and the catch section is situated between the first and second retaining elements and a sliding engagement may be formed in the mounting direction with a corresponding receptacle of the turbomachine with the aid of the second retaining element.

14. The turbomachine as recited in claim 11 wherein the inner leg is inclined by a blade angle in the mounting direction.

15. The turbomachine as recited in claim 11 wherein the outer leg extends in the mounting direction.

16. The turbomachine as recited in claim 11 wherein the mounting angle is at least 10° smaller than a minimum safety angle.

17. The turbomachine as recited in claim 16 wherein the mounting angle is 20° to 30° smaller than the minimum safety angle.

18. The turbomachine as recited in claim 16 wherein the spring section is situated in front of the catch section in the mounting direction and the catch section merges in the mounting direction into a rear free end section.

19. The turbomachine as recited in claim 11 wherein the spring section is situated in front of the catch section in the mounting direction and the catch section merges in the mounting direction into a rear free end section.

20. The turbomachine as recited in claim 11 wherein the spring section is situated in front of the catch section in the mounting direction and the catch section merges in the mounting direction into a rear free end section.

* * * * *